United States Patent [19]

Kanamori et al.

[11] Patent Number: 4,748,436

[45] Date of Patent: May 31, 1988

[54] NOISE PREVENTION HIGH VOLTAGE RESISTANCE WIRE

[75] Inventors: Yasuo Kanamori; Masahiro Kanda, both of Shizuoka, Japan

[73] Assignee: Yazaki Corporation, Japan

[21] Appl. No.: 52,411

[22] Filed: May 21, 1987

[30] Foreign Application Priority Data

May 22, 1986 [JP] Japan ..... 61-116103

[51] Int. Cl.[4] ..... H01C 3/06

[52] U.S. Cl. ..... 338/214; 338/66

[58] Field of Search ..... 338/214, 66

[56] References Cited

U.S. PATENT DOCUMENTS 3,284,751 11/1966 Barker et al. ..... 338/214 X
3,518,606 6/1970 Barker ..... 338/214
3,683,309 8/1972 Hirose ..... 338/214
3,870,987 3/1975 Wiley et al. ..... 338/214
4,435,692 3/1984 Miyamoto et al. ..... 338/214
4,689,601 8/1987 Coffey et al. ..... 338/214

*Primary Examiner*—C. L. Albritton
*Attorney, Agent, or Firm*—Wigman & Cohen

[57] ABSTRACT

To reduce resistance change due to heat and external force, the noise prevention high-voltage resistance wire comprises a non-metallic reinforcing core wire; a conductive composite including gaseous phase growth carbon fiber, in particular; and at least one insulating layer. The gaseous phase growth carbon fiber is obtained by thermal decomposition of hydrocarbon compound with a catalyzer within a reducing atmosphere. Further, the conductive composite further comprises preferably conductive carbon powder such as conductive carbon black or graphite.

16 Claims, 6 Drawing Sheets

NOISE PREVENTION HIGH VOLTAGE RESISTANCE WIRE

BACKGROUND OF THE INVENTION

1. Field of the Invention

The present invention relates to a noise prevention high voltage resistance wire, and more specifically to an ignition cord used for an automotive vehicle.

2. Description of the Prior Art

Wires such that a non-metallic conductive wire is covered by insulation material have conventionally been used as noise prevention high voltage resistance wires for automotive vehicle ignition cords.

These non-metallic conductor wires are manufactured by applying or extruding a conductive composite around a heat-resistance reinforcing core-wire such as glass fiber or aromatic polyamide fiber, and the conductive composite is manufactured by mixing conductive carbon material such as graphite powder or conductive carbon block with heat resistance rubber or plastic.

In these prior-art non-metallic conductors, however, there exists a problem such that the electric resistance changes markedly according to change in temperature. To overcome this problem, some attempts that carbon fiber is used as the conductive carbon material have so far been made.

An example of these attempts is disclosed in Japanese Published Unexamined Patent Appl. No. 55-122308, in which carbon fiber is combined with carbon particle (e.g. carbon black) or graphite particle. This carbon fiber used as conductive material should be cut off or pulverized to a several millimeter or one millimeter length (in some cases) so as to be uniformly mixed with silicon rubber or fluorine rubber.

In the prior-art conductive material based upon pulverized pitch carbon fiber, however, there exist other problems in that a sufficient conductivity cannot be obtained unless a great quantity of graphite of a high graphitization is mixed and further where a great quantity of graphite is mixed, the processability or workability of the combined composite is degraded and additionally the resistance value is scattered, thus resulting in a difficulty in manufacturing a uniform resistance wire.

On the other hand, in the case of carbonized synthetic fiber (e.g. PAN carbon fiber), since fine split or nap is readily produced and the length of the fiber is different when the fiber is pulverized, there still exist problems in that the processability of the combined conductive composite is not excellent and also the conductivity is dispersed. To prevent fiber nap produced when the fiber is pulverized and to improve the processability, the carbon fiber is often processed by various organic agents (e.g. a surface active agent, a high molecular substance, etc.). However, this processing will exert a harmful influence upon the conductivity characteristics of the wire.

In summary, non-metallic conductor made of conductive composite including carbon fiber involves various problems such that the processability is not good; the characteristics are not uniform; the resistance is not stable against temperature change; and the conductivity is not stable against internal stress change due to an external force such as bending.

SUMMARY OF THE PRESENT INVENTION

With these problems in mind, therefore, it is the primary object of the present invention to provide a noise prevention high voltage resistance wire which can settle various problems involved in the prior-art resistance wires by use of a specific carbon fiber.

To achieve the above-mentioned object, a noise prevention high voltage resistance wire according to the present invention, including a non-metallic reinforcing core wire; a conductive composite including carbon conductive material and formed so as to cover said reinforcing core wire; and at least one insulating layer formed so as to cover said conductive composite, characterized in that said conductive composite includes gaseous phase growth carbon fiber.

The gaseous phase growth carbon fiber is obtained by thermal decomposition of hydrocarbon compound with a catalyzer within a non-oxidizing atmosphere. It is preferable that the conductive composite further comprises conductive carbon powder. That is, the conductive composite comprises base polymer of 100 weight proportion; and carbon conductive material of 10 to 120 weight proportion including 30 to 90 wt.% gaseous phase growth carbon fiber and 10 to 70 wt.% conductive carbon powder. The base polymer is a flexible high molecular compound, and the conductive carbon powder is conductive carbon black or graphite of 10 to 50 μm particle diameter. The conductive composite further comprises an antioxidant, crosslinking agent and/or assistant, where necessary. The prepared conductive composite is extrusion coated or dip-applied around the non-metallic reinforcing core wire.

BRIEF DESCRIPTION OF THE DRAWINGS

The features and advantages of the noise prevention high voltage resistance wire according to the present invention will be more clearly appreciated from the following description of the preferred embodiment of the invention taken in conjunction with the accompanying drawings in which.

DETAILED DESCRIPTION OF THE PREFERRED EMBODIMENTS

Figure 1:
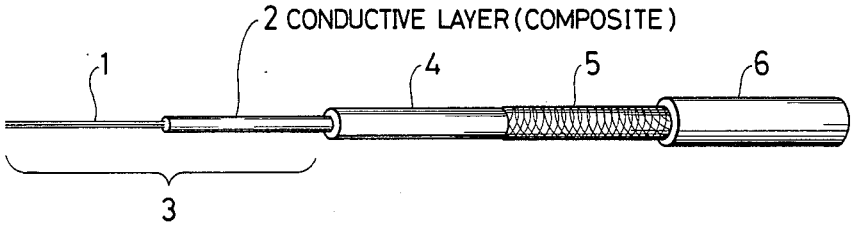
FIG. 1 is a perspective view showing a noise prevention high voltage wire according to the present invention.

FIG. 1 shows a noise prevention high voltage resistance wire according to the present invention, which comprises a non-metallic conductor 3 including a reinforcing core wire 1 (e.g. glass fiber or aromatic polyamide fiber) provided with heat resistance and high tensile strength and a conductive layer 2 formed by applying (by dipping) or extruding a conductive composite of the present invention on the core wire 1; an insulation coating layer 4 made of a heat resistant, durable rubber material; a braided layer 5 formed by glass fiber, for instance; and a sheath 6.

The non-metallic conductive layer 2 of the present invention is a conductive composite mixed with base polymer (100 weight ratio), carbon conductive material (10 to 120 weight ratio) comprising 30 to 90 wt.% gaseous phase growth carbon fiber and 10 to 70 wt.% carbon conductive material (e.g. carbon black, graphite, etc.), and antioxidant, crosslinking agent, assistant, etc., where necessary.

The base polymer is a flexible high molecular substance such as chloroprene rubber, chlorinated polyethylene, chlorosulfonic polyethylene, acryl rubber, silicon rubber, ethylene-propylene rubber, ethylene-acryle copolymer resin, ethylene-vinylacetate copolymer resin, polyethylene resin, fluorine rubber, or other resin or rubber. Among those, chlorosulfonic polyethylene, silicon rubber, EPDM, fluorine rubber, ethylene-acryle copolymer resin are preferable.

On the other hand, the carbon conductive material is a combination of gaseous phase growth carbon fiber and conventional conductive carbon powder particle such as conductive carbon black or graphite powder. The carbon powder of developed structure is preferable. High-conductive carbon black such as Ketjen Black (Trademark of Lion Akzo Corp.) with carbon particle diameters of 10 to 15 μm is particularly preferable.

The above gaseous phase growth carbon fiber is obtained by decomposing hydrocarbon compound with a thermal cracking catalyzer within a non-oxidizing atmosphere.

The gaseous phase growth carbon fiber as described above can be obtained in accordance with the method as follows: a carrier substrate onto which fine particle of transition metal (e.g. iron) or the compound is attached as catalyzer is placed in a mullite reaction tube arranged in a horizontal electric furnace; a gaseous mixture of a carrier (e.g. hydrogen) and a hydrocarbon compound (e.g. ethane, benzene) is introduced thereinto at 1000° to 1400° C. to grow carbon fiber by thermodecomposing the hydrocarbon brought into contact with the substrate; and the grown carbon fiber is collected.

In another method, a substrate (e.g. ceramics) including silicon is placed within the same reaction apparatus; a mixture gas of a carrier (e.g. hydrogen), a hydrocarbon compound (e.g. ethane, benzene), and a sulfur containing substance (e.g. simple substance sulfur, hydrogen sulfide, mercaptane) or a mixture gas of a carrier (e.g. hydrogen) and a sulfur containing hydrocarbon compound (e.g. dibenzothiophene) is introduced thereinto at 1200° to 1400° C. to grow carbon fiber by thermodecomposing the hydrocarbon brought into contact with the substrate; and the grown carbon fiber is collected.

The gaseous phase growth carbon fiber with a diameter of 10 μm and a length of 5 to 6 cm can be obtained according to reaction conditions. In the present invention, however, carbon fiber with a diameter of 1μ and a length of 5 to 6 mm is the most preferable.

The mixture proportion of carbon powder and gaseous phase growth carbon fiber in the carbon conductive material is such that the carbon fiber is 30 to 90% by weight relative to the sum total of the carbon powder and the carbon fiber, and more preferably 40 to 80% by weight.

The conductive composite 2 can be obtained by mixing the carbon conductive material (gaseous phase growth carbon fiber plus conductive carbon black or graphite) with base polymer at a ratio of 10–120 to 100 by weight. Further, antioxidant, crosslinking agent, assistant are combined therewith appropriately according to the necessity.

The conductive composite 2 thus prepared is used for covering the reinforcing core wire in accordance with the conventional method, and thereafter the various insulating layers 4, 5 and 6 are formed thereupon as is usual to obtain the high resistance wire according to the present invention.

Some examples of the resistance wire according to the present invention will now be described hereinbelow. However, the present invention is of course not limited only to these examples.

EXAMPLE 1

Chlorosulfonic polyethylene (Hypalon 45: Trademark of Du Pont Corp.) of 100 weight proportion was kneaded by a kneader as a base polymer; conductive carbon black (Ketjen Black EC: Trademark of Lion Akzo Corp.) of 10 weight proportion was mixed with the kneaded Hypalon; gaseous phase growth carbon fibers and conventional carbon fibers as listed in Table 1 were added and well mixed therewith; and an antioxidant (Irganox 1035: Trademark of Ciba-Geigy Corp.) of 1.5 weight proportion was uniformly mixed. The mixture was taken out of the kneader, and toluence was added to the mixture within a paint preparing machine to obtain a paint.

The listed carbon fibers are as follows:

(a) FS: Gaseous phase growth carbon fiber (with a diameter of about 1 to 2 μm and a length of about 0.8 to 1.0 mm), which was obtained by use of sulfur/silicon catalyzer.

(b) FF: Gaseous phase growth carbon fiber (with a diameter of about 1 to 2 μm and a length of about 0.8 to 1.0 mm), which was obtained by use of an iron catalyzer.

(c) FN: Pulverized carbon fiber (Torayca MLD-300: Trademark of TOYO RAYON Corp.) (with a diameter of about 7 μm and a length of about 0.3 mm), which was obtained by carbonizing PAN synthetic fiber.

The conductive paint thus obtained was applied thin and uniform on a flat glass, dried for 30 min. at room temperature and further for 30 min. at 140° C.

The volume resistivity of the obtained paint film was measured as listed in Table 1.

This conductive paint was applied onto a white vaseline applied thin on a flat glass, dried for 5 hours at room temperature and further dried for one hour at 140° C. The sheet thickness was about 1 mm. Tensile test was made for these sheets in accordance with JIS K6301. These test results are also shown in Table 1.

These conductive materials were applied around a reinforcing core wire having 6 pieces of glass fiber each with a diameter of 270 μm, separately by dip coating method, to obtain non-metallic conductors of an external diameter of 1.6 mm. The changes in electric resistance due to heat and bending stress were measured for each non-metallic conductor.

Electric Resistance Change Due to Heat

Figure 2A:
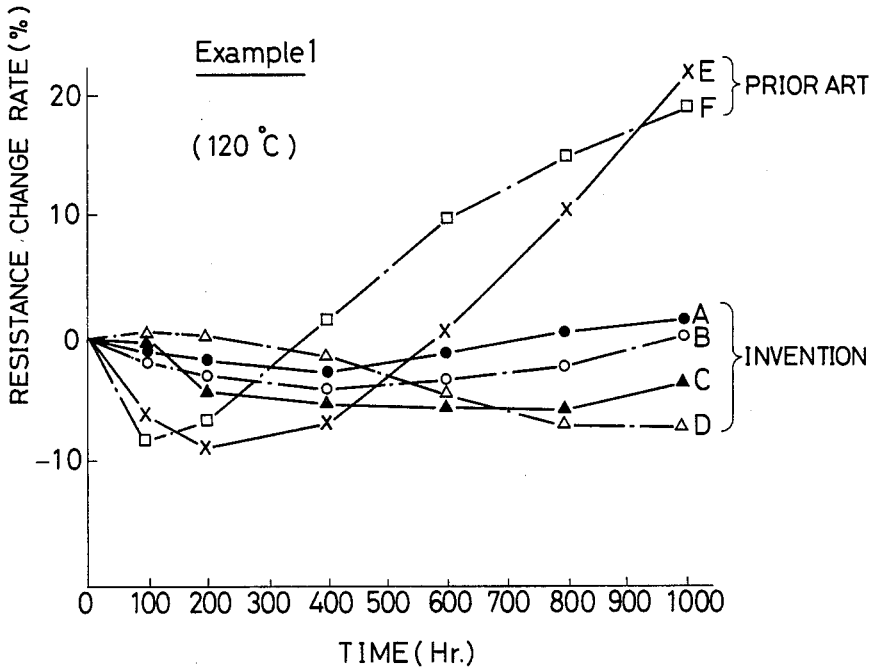
FIG. 2A is a graphical representation showing changes with the passage of time in electric resistance of non-metallic conductors (Example 1) at 120° C.

FIG. 2A shows changes in resistance with the elapse of time (1000 hours) relative to an initial value, which were obtained when the non-metallic conductors of Example 1 were kept at 120° C. FIG. 2A indicates that the resistance changes greatly in the prior-art samples E and F, but relatively small in the samples A, B, C and D of the present invention.

Figure 2B:
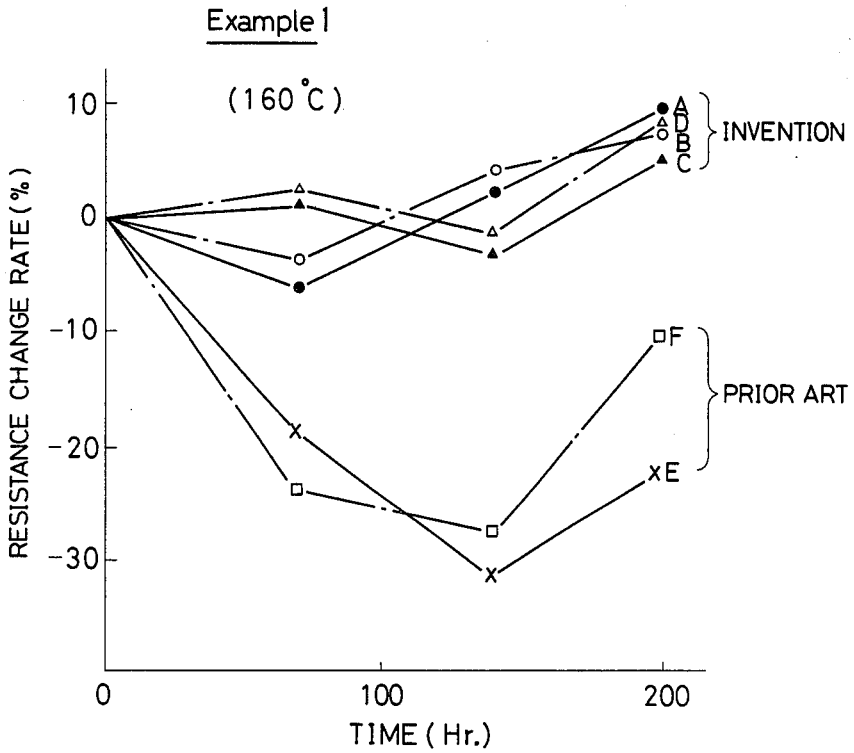
FIG 2B is a similar graphical representation showing changes with the passage of time in electric resistance of the same non-metallic conductors (Example 1) at 160° C.

FIG. 2B shows similar changes in resistance with the elapse of time (200 hours), which were obtained when the non-metallic conductors of the same Example 1 were kept at 160° C. FIG. 2B also indicates that change in resistance is relatively great in the prior-art samples E and F, but small in the samples A, B, C and D of the present invention.

Electric Resistance Change Due to Bending

Figure 3:
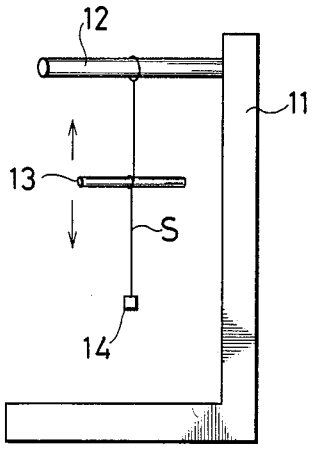
FIG. 3 is an illustration showing a test device for examining the influence of bending upon electric resistance of the non-metallic conductors.

The electric resistance was measured with a test device as shown in FIG. 3. The test device includes an L-shaped base frame 11 and an arm 12 horizontally attached on top of the base frame 11. On end of a non-metallic conductor sample S with a length of about 100 cm was fixed to the arm 2; and an intermediate portion of the sample S was wound one turn around a cylindrical mandrel with a diameter of about 25 mm; and the other end of the sample S was connected to a weight of 1 kgw. Under these conditions, the mandrel 13 was rotated and moved up and down with a stroke of about 70 cm. Thereafter, the sample intermediate portion was cut away to measure the electric resistance.

Figure 4:
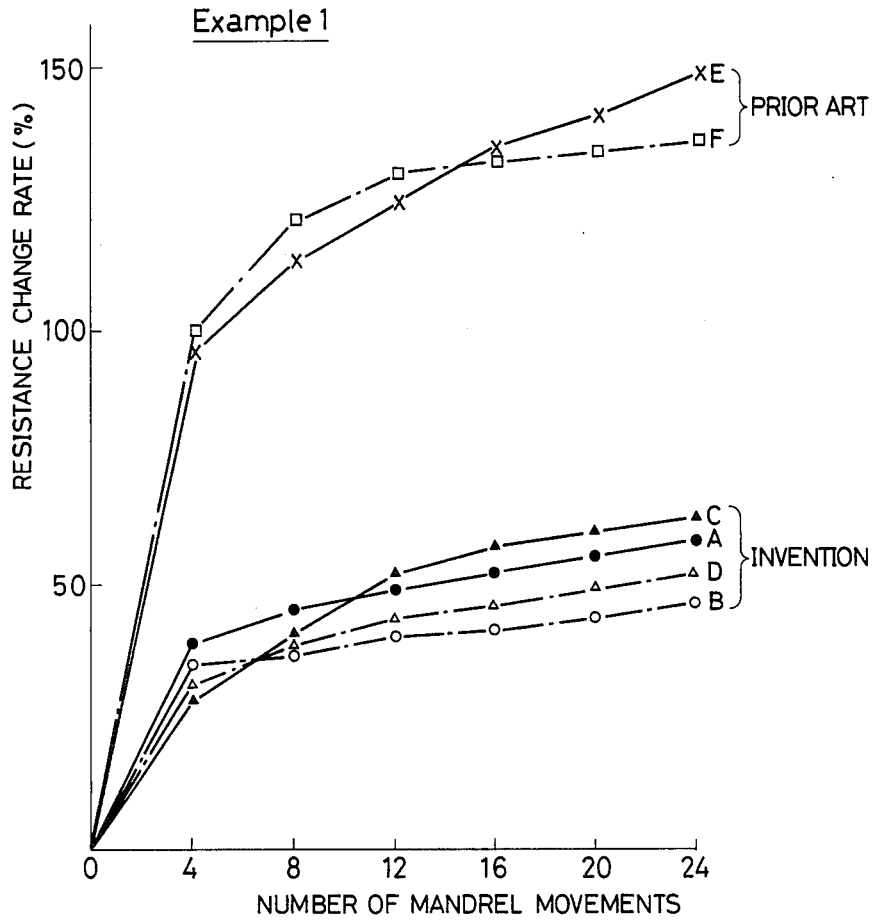
FIG. 4 is a graphical representation showing changes in electric resistance due to alternating bending stress applied to the non-metallic conductors (Example 1)

FIG. 4 shows the change rate of sample resistance due to alternating bending stress caused by the up-and-down moving and rotating mandrel 13. The abscissa indicates the number of mandrel movements, while the ordinate indicates the change rate with the initial electric resistance value as the basis.

FIG. 4 indicates that change in resistance is fairly small in the invention samples A to C including the conductive material of the gaseous phase growth carbon fiber according to the present invention in comparison with the prior-art samples E and F.

EXAMPLE 2

Additive reaction liquid silicon rubber (OY35-055: TORE SILICON Corp.) was used as the base polymer. The same carbon powder and the same carbon fiber as in Example 1 were kneaded at mixture ratios listed in Table 2 in the same procedure as in Example 1. In addition, a crosslinking speed controlling inhibitor (MR-23: TORE SILICON Corp.) of 0.07 weight proportion and a chloroplatinic acid crosslinking catalyzer of 1 weight proportion were added and kneaded uniformly to obtain a conductive silicon rubber composite. The composite thus obtained was formed into a 150×150×1 mm crosslinked sheet with a press at 150° C. for 5 min.

The volume resistivity of the obtained sheet was measured, and the measurement results are listed in Table 2. Tensile test of the same sheets was effected in accordance with JIS K6301. The test results are also listed in Table 2.

The conductive composite thus obtained was extruded around a reinforcing core wire of three pieces of 180 μm-dia. aromatic polyamide fiber (Keblar: Trademark of Du Pont Corp.) for coating, and then heated for 30 sec. at 200° C. for crosslinking, to obtain a non-metallic conductor with a 0.93 mm external diameter.

The changes in electric resistance due to heat and bending stress were measured for each non-metallic conductor.

Electric Resistance Change Due to Heat

Figure 5A:
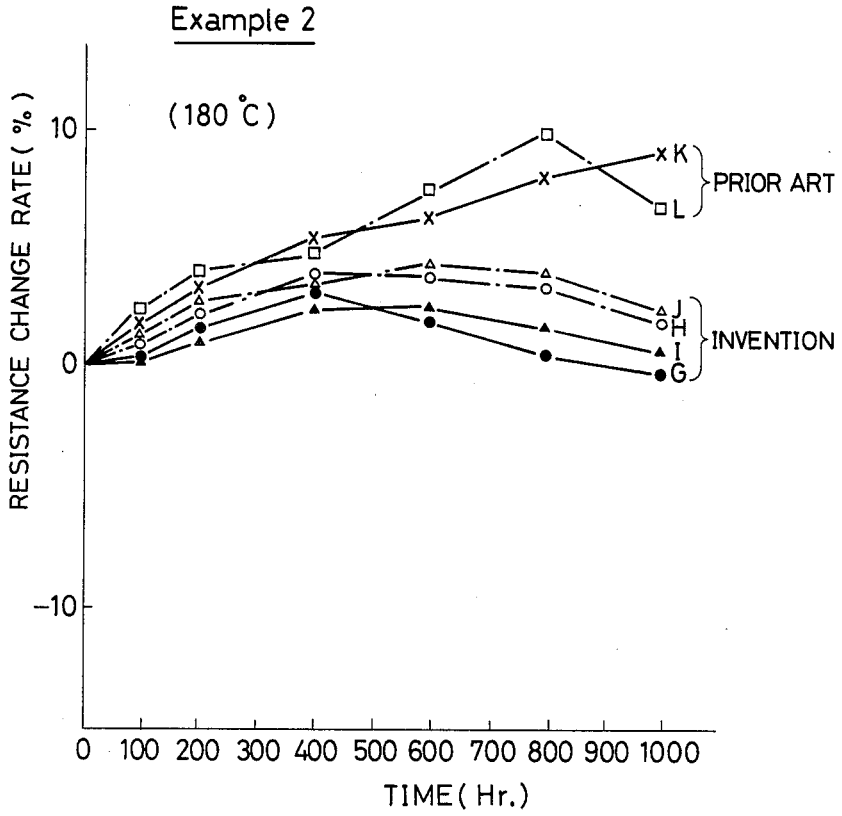
FIG. 5A is a graphical representation showing changes with the passage of time in electric resistance of non-metallic conductors (Example 2) at 180° C.

FIG. 5A shows changes in resistance with the elapse of time (1000 hours) relative to the initial value, which were obtained when the non-metallic conductor samples were kept at 120° C. FIG. 5A indicates that the resistance changes relatively small in the invention samples G, H, I and J in comparison with the prior art samples K and L.

Figure 5B:
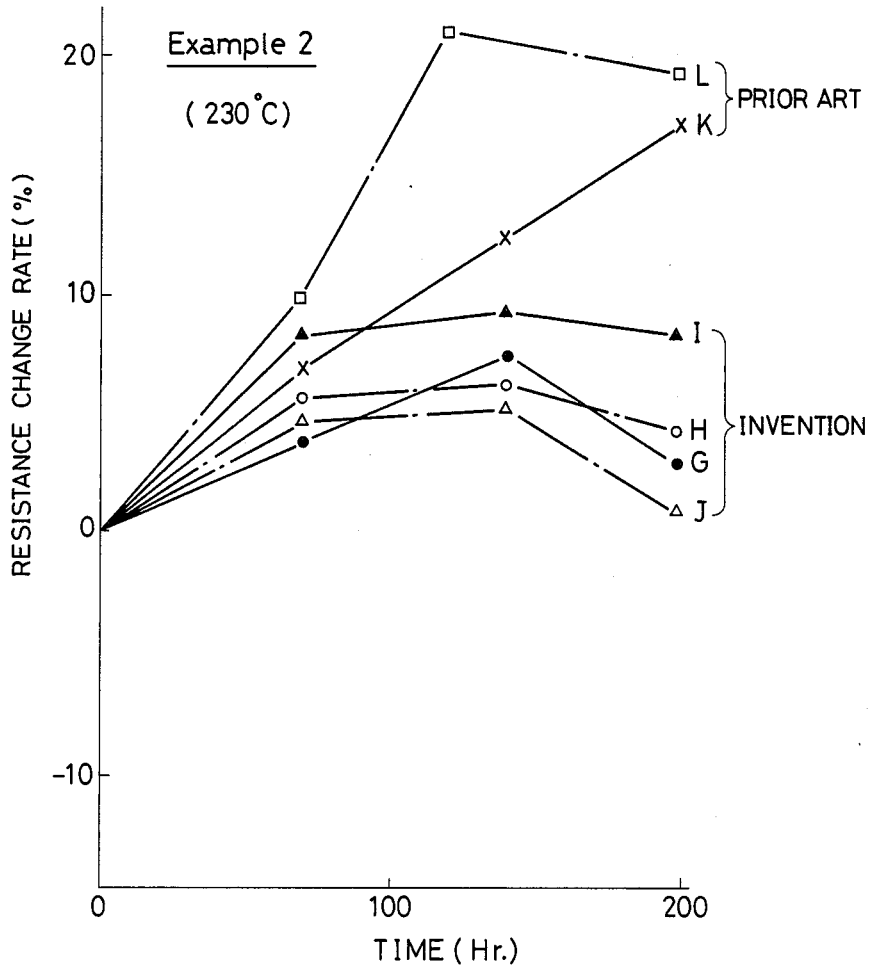
FIG. 5B is a similar graphical representation showing changes with the passage of time in electric resistance of the same non-metallic conductors (Example 2) at 230° C.

FIG. 5B shows similar changes in resistance with the elapse of time (200 hours), which were obtained when the non-metallic conductor samples were kept at 230° C. FIG. 5B indicates that the resistance changes relatively small in the invention samples G, H, I and J in comparison with the prior art samples K and L.

ELECTRIC RESISTANCE CHANGE DUE TO BENDING

Figure 6:
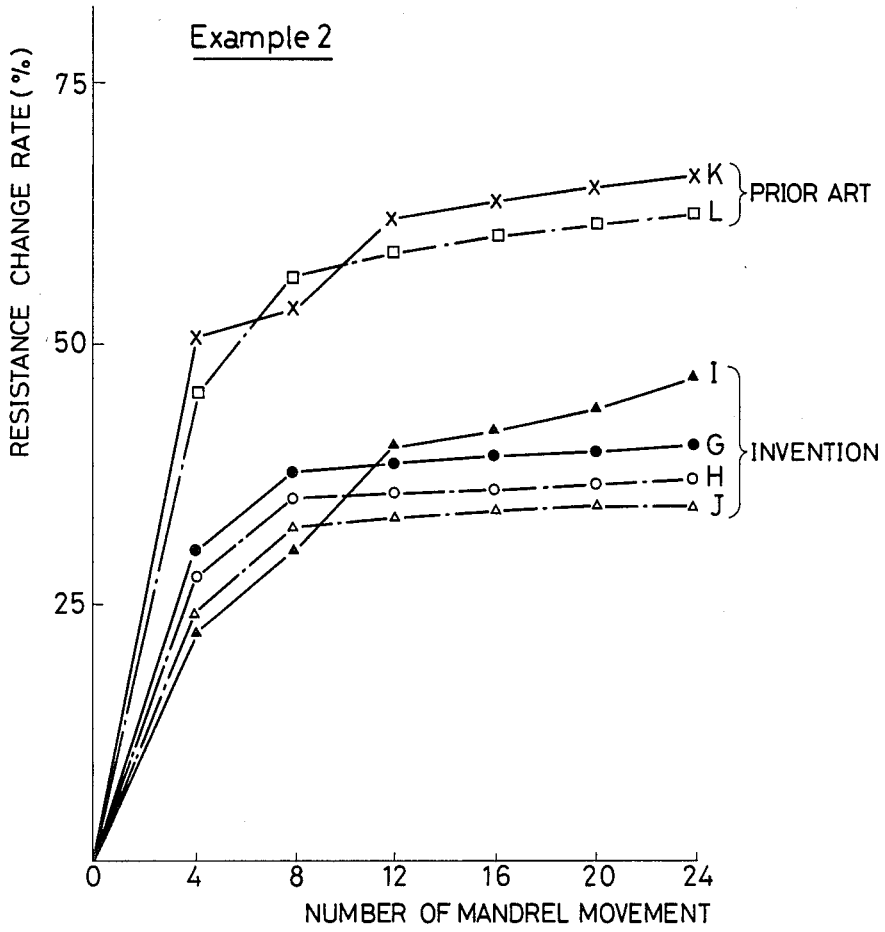
FIG. 6 is a graphical representation showing changes in electric resistance due to alternating bending stress applied in the non-metallic conductors (Example 2).

In quite the same way as in Examples 1, the non-metallic conductor samples S were measured with the test device. FIG. 6 shows the test results, indicating that change in resistance is fairly small in the invention samples G to J in comparison with the prior art samples K and L.

The above test results all indicate that the conductive non-metallic rubber composite including gaseous phase growth carbon fiber according to the present invention is small in change of electric resistance due to application of heat and alternating bending stress, so that the noise prevention high-voltage resistance wire of non-conductive conductor according to the present invention is resistant against heat and bending stress and therefore long in lifetime.

In addition, since the thermal coefficient of the electric resistance of the gaseous phase growth carbon fiber is positive, where used together with conductive carbon powder having negative thermal coefficient in electric resistance, it is possible to further reduce the thermal coefficient thereof.

Therefore, the noise prevention high voltage resistance wire of the present invention has a stable electric resistance of a small thermal coefficient, thus it being possible to supply a stable ignition energy to an internal combustion engine.

TABLE 1

Unit: Weight ratio

| COMPOSITE | A | B | C | D | E* | F* |
|---|---|---|---|---|---|---|
| Base polymer | 100 | 100 | 100 | 100 | 100 | 100 |
| Carbon powder | 10 | 10 | 10 | 10 | 10 | 10 |
| Invention carbon fiber FS | 10 | 30 | — | — | — | — |
| Invention carbon fiber FF | — | — | 10 | 30 | — | — |
| Prior-art carbon fiber FN | — | — | — | — | 10 | 30 |

TABLE 1-continued

| COMPOSITE | A | B | C | D | E* | F* |
|---|---|---|---|---|---|---|
| | Unit: Weight ratio | | | | | |
| Antioxidant | 1.5 | 1.5 | 1.5 | 1.5 | 1.5 | 1.5 |
| Toluene | 486 | 566 | 486 | 566 | 486 | 566 |
| Volume resistivity (Ohm-cm) | 2.43 | 1.37 | 2.31 | 1.29 | 2.63 | 1.59 |
| Tensile strength (kgf/cm$^2$) | 134 | 155 | 129 | 118 | 121 | 108 |
| Elongation (%) | 205 | 244 | 235 | 209 | 185 | 168 |

*Prior-art composites

TABLE 2

| COMPOSITE | G | H | I | J | K* | L* |
|---|---|---|---|---|---|---|
| | Unit: Weight ratio | | | | | |
| Base polymer | 100 | 100 | 100 | 100 | 100 | 100 |
| Carbon powder | 20 | 20 | 20 | 20 | 20 | 20 |
| Invention carbon fiber FS | 10 | 30 | — | — | — | — |
| Invention carbon fiber FF | — | — | 10 | 30 | — | — |
| Prior-art carbon fiber FN | — | — | — | — | 10 | 30 |
| Inhibitor | 0.07 | 0.07 | 0.07 | 0.07 | 0.07 | 0.07 |
| Crosslinking catalyst | 1 | 1 | 1 | 1 | 1 | 1 |
| Volume resistivity (Ohm-cm) | 1.86 | 0.93 | 1.71 | 0.84 | 2.43 | 1.26 |
| Tensile strength (kgf/cm$^2$) | 57.3 | 61.3 | 55.9 | 62.3 | 50.7 | 57.2 |
| Elongation (%) | 310 | 285 | 324 | 300 | 345 | 321 |

*Prior-art composites

What is claimed is:

1. In a noise prevention high voltage resistance wire including:

a non-metallic reinforcing core wire;

a conductive composite including carbon conductive material and formed so as to cover said reinforcing core wire; and at least one insulating layer formed so as to cover said conductive composite, the improvement wherein said conductive composite includes gaseous phase growth carbon fiber.

2. The noise prevention high voltage resistance wire as set forth in claim 1, wherein said gaseous phase growth carbon fiber is obtained by thermal decomposition of hydrocarbon compound with a catalyzer within a non-oxidizing atmosphere.

3. The noise prevention high voltage resistance wire as set forth in claim 2, wherein said gaseous phase growth carbon fiber is obtained in accordance with the following steps of:

(a) placing a carrier substrate on which fine particles of one of transition metal and transition metal compound are attached as a catalyzer, within a mullite reaction tube arranged in a furnace; and (b) introducing a gas mixture of a carrier and hydrocarbon compound into the furnace at a temperature of 1000° to 1400° C. to grow carbon fiber by thermodecomposing the hydrocarbon in contact with the substrate.

4. The noise prevention high voltage resistance wire as set forth in claim 2, wherein said gaseous phase growth carbon fiber is obtained in accordance with the following steps of:

(a) placing a substrate of ceramics including silicon within a mullite reaction tube arranged in a furnace;

(b) introducing a gas mixture of a carrier, hydrocarbon compound and sulfur including substance at a temperature of 1200° to 1400° C. to grow carbon fiber by thermodecomposing the hydrocarbon in contact with the substrate.

5. The noise prevention high voltage resistance wire as set forth in claim 1, wherein said gaseous phase growth carbon fiber is 1 μm in diameter and several cm in length.

6. The noise prevention high voltage resistance wire as set forth in claim 1, wherein said conductive composite further comprises conductive carbon powder.

7. The noise prevention high voltage resistance wire as set forth in claim 6, wherein said conductive composite comprises:

(a) base polymer of 100 weight proportion; and (b) carbon conductive material of 10 to 120 weight proportion including 30 to 90 wt.% gaseous phase growth carbon fiber and 10 to 70 wt.% conductive carbon powder.

8. The noise prevention high voltage resistance wire as set forth in claim 7, wherein said base polymer is a flexible high molecular compound.

9. The noise prevention high voltage resistance wire as set forth in claim 7, wherein said conductive carbon powder is conductive carbon black.

10. The noise prevention high voltage resistance wire as set forth in claim 7, wherein said conductive carbon powder is graphite.

11. The noise prevention high voltage resistance wire as set forth in claim 7, wherein said conductive carbon powder is 10 to 50 μm in particle diameter.

12. The noise prevention high voltage resistance wire as set forth in claim 7, which further comprises an antioxidant.

13. The noise prevention high voltage resistance wire as set forth in claim 7, which further comprises a crosslinking agent.

14. The noise prevention high voltage resistance wire as set forth in claim 7, which further comprises an assistant.

15. The noise prevention high voltage resistance wire as set forth in claim 1, wherein said conductive composite is extrusion coated around said non-metallic reinforcing core wire.

16. The noise prevention high voltage resistance wire as set forth in claim 1, wherein said conductive composite is dip-applied around said non-metallic reinforcing core wire.

* * * * *